US010410553B2

(12) United States Patent
Holyfield et al.

(10) Patent No.: US 10,410,553 B2
(45) Date of Patent: Sep. 10, 2019

(54) METHOD AND APPARATUS FOR SUPPORTING A BANNER

(71) Applicants: Kenneth Holyfield, Montrose, CO (US); Robert Holyfield, Asotin, WA (US); Dwight Dutton, Montrose, CO (US)

(72) Inventors: Kenneth Holyfield, Montrose, CO (US); Robert Holyfield, Asotin, WA (US); Dwight Dutton, Montrose, CO (US)

( * ) Notice: Subject to any disclaimer, the term of this patent is extended or adjusted under 35 U.S.C. 154(b) by 0 days.

(21) Appl. No.: 16/053,162

(22) Filed: Aug. 2, 2018

(65) Prior Publication Data

US 2019/0043391 A1 Feb. 7, 2019

Related U.S. Application Data

(60) Provisional application No. 62/540,915, filed on Aug. 3, 2017.

(51) Int. Cl.
*G09F 17/00* (2006.01)
*G09F 7/18* (2006.01)

(52) U.S. Cl.
CPC ..... *G09F 17/00* (2013.01); *G09F 2007/1834* (2013.01); *G09F 2017/0041* (2013.01)

(58) Field of Classification Search
CPC . G09F 17/00; G09F 2017/0041; E04H 17/00; E04H 17/04; E04H 17/006; E04H 17/08; E04H 2017/1452; E04H 2017/1482
See application file for complete search history.

(56) References Cited

U.S. PATENT DOCUMENTS 1,756,389 A 4/1930 Schneider
2,146,113 A 2/1939 Erickson
3,034,242 A 5/1962 Gold
3,868,630 A 2/1975 Lesondak
4,480,403 A * 11/1984 Williams ..... A01G 17/14 47/42
4,642,946 A 2/1987 Koch
4,658,527 A 4/1987 Pingel
4,679,772 A * 7/1987 Peterson ..... E04H 17/08 256/35
4,878,303 A 11/1989 Banniza
4,889,322 A * 12/1989 Wagner ..... E04H 17/08 256/36
4,936,550 A 6/1990 Wickham
5,388,794 A 2/1995 Wolff
(Continued)

*Primary Examiner* — Cassandra Davis
(74) *Attorney, Agent, or Firm* — Spencer Gibbs

(57) ABSTRACT

Banner supports and processes for making and using same. In some examples, a banner support can include at least one end connector having body which defines an aperture that is sized to allow a t-post to extend through the aperture, the end connector including at least one tab and an elongate support structure configured for connecting to a top edge of a banner and having a strength capable at least of supporting the banner, the support structure having an end with an end opening that is configured to selectively receive the end connector tab for attaching the end connector to the support structure in a locked position, and configured to selectively release the tab to at least partially detach the end connector from the support structure.

20 Claims, 12 Drawing Sheets

(56) References Cited

U.S. PATENT DOCUMENTS 5,402,988 A * 4/1995 Eisele ..... E01F 13/022 160/351
5,428,913 A 7/1995 Hillstrom
5,518,333 A * 5/1996 Cienkus, Jr. ..... E04H 17/06 256/59
5,522,165 A 6/1996 Molla
5,732,494 A 3/1998 Davey
5,884,424 A 3/1999 Smith
6,009,652 A 1/2000 Smith
6,161,339 A 12/2000 Cornett
6,192,611 B1 2/2001 Molla
6,330,998 B1 12/2001 Roy
6,334,596 B1 1/2002 Temple
6,370,803 B1 4/2002 Burquest
6,493,973 B1 12/2002 Nelson
6,618,973 B2 9/2003 Nelson
6,705,598 B2 * 3/2004 Collins ..... E04H 17/08 256/35
6,826,861 B2 12/2004 Alexander
6,883,785 B1 * 4/2005 Knapp ..... A01K 3/00 256/1
7,121,029 B2 10/2006 Wilson
7,347,018 B2 3/2008 Haggard
7,774,967 B1 8/2010 Jones
7,966,757 B2 6/2011 Hyung-Chul
8,113,473 B2 2/2012 Bradley
8,327,565 B2 12/2012 Boltz
8,732,999 B1 5/2014 Hughes
2003/0146426 A1 * 8/2003 Ray ..... A01K 3/00 256/59
2004/0173724 A1 9/2004 Tolna
2005/0077441 A1 4/2005 Coverstone
2005/0230339 A1 10/2005 Hartger
2011/0138664 A1 6/2011 Wells
2011/0197480 A1 8/2011 Nasiatka
2013/0047478 A1 2/2013 Chang
2013/0228137 A1 9/2013 Gemino
2016/0267824 A1 9/2016 Lacross

* cited by examiner

METHOD AND APPARATUS FOR SUPPORTING A BANNER

CROSS-REFERENCE TO RELATED APPLICATION

This application is related to and claims the priority of U.S. Provisional Patent Application No. 62/540,915 filed Aug. 3, 2017, which is hereby incorporated herein by reference in its entirety.

BACKGROUND

Description of the Related Art

Banners can be used for advertising products and/or services. Some banners are installed outdoors as a way to display a promotional message to people passing by on foot or by vehicle. Some banners are connected between t-posts for display because t-posts are easy to install, readily available, and are relatively inexpensive. However, banners are typically made from a flexible material and when the banner is wind loaded the t-posts can bend toward one another which can cause the banner to lose support and become loose and saggy. Once the banner becomes loose, readability of the banner is reduced and the banner can be damaged.

Some banner installers have used guy-wires to stabilize the t-posts, but guy-wires introduce other problems and are unsightly. The use of guy-wires can make lawn care more difficult and can introduce a tripping risk when installed in locations where there is foot traffic. Guy-wires can also be difficult and/or time consuming to install.

There is a need, therefore, for a banner support that can maintain support of the banner during wind loading and which can be easily assembled, disassemble, and can be re-used.

SUMMARY

Banner supports and processes for making and using same are provided. In some examples, a method of supporting a banner includes installing a first t-post at first position with a first t-post first end extending away from the ground, and installing a second t-post at a second position, at a spaced apart distance from the first position, with a second t-post first end extending away from the ground. A first end connector can be placed over the first t-post first end and positioning the first end connector between two studs of the first t-post that are spaced apart from one another and spaced apart from the first t-post first end. A second end connector can be placed over the second t-post second end and positioning the second end connector between two studs of the second t-post that are spaced apart from one another and spaced apart from the second t-post first end. A first end connector tab of the first end connector can be inserted into a first end of an elongate support structure and securing the first end connector tab of the first end connector in the first end of the support structure such that the first end of the support structure and the first end connector cooperate to maintain the first end connector between the two studs of the first t-post to support the first end of the support structure. A first end connector tab of the second end connector can be inserted into a second end of the elongate support structure and securing the first end connector tab of the second end connector in the second end of the support structure such that the second end of the support structure and the second end connector cooperate to maintain the second end connector between the two studs of the second t-post to support the second end of the support structure. At least a portion of a top edge of the banner can be attached to the support structure.

In one or more embodiments, a banner support can include at least one end connector having body which defines an aperture that is sized to allow a t-post to extend through the aperture, the end connector including at least one tab. An elongate support structure can be configured for connecting to a top edge of a banner and having a strength capable at least of supporting the banner, the support structure having an end with an end opening that is configured to selectively receive the end connector tab for attaching the end connector to the support structure in a locked position, and configured to selectively release the tab to at least partially detach the end connector from the support structure. A retainer assembly can selectively maintain the end connector attached to the support structure in the locked position, and wherein the end connector and the support structure are configured such that when the t-post extends through the aperture and the end connector is in the locked position, the end connector engages the t-post and is prevented from moving past studs of the t-post to support the end of the support structure, and when the t-post extends through the aperture and the end connector is not in the locked position, the end connector is able to move past the studs of the t-post and can be positioned along the length of the t-post.

In one or more embodiments, a banner support can include at least one end connector having body which defines an aperture that is sized to allow a t-post to extend through the aperture, the end connector including at least one tab. An elongate support structure can be configured for connecting to a top edge of a banner and having a strength capable at least of supporting the banner, the support structure having an end with an end opening that is configured to selectively receive the end connector tab for attaching the end connector to the support structure in a locked position, and configured to selectively release the tab to at least partially detach the end connector from the support structure. A retainer assembly can selectively maintain the end connector attached to the support structure in the locked position, and wherein the end connector and the support structure are configured such that when the t-post extends through the aperture and the end connector is in the locked position, the end connector engages the t-post and is prevented from moving past studs of the t-post to support the end of the support structure, and when the t-post extends through the aperture and the end connector is not in the locked position, the end connector is able to move past the studs of the t-post and can be positioned along the length of the t-post.

DETAILED DESCRIPTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

Figure 1:
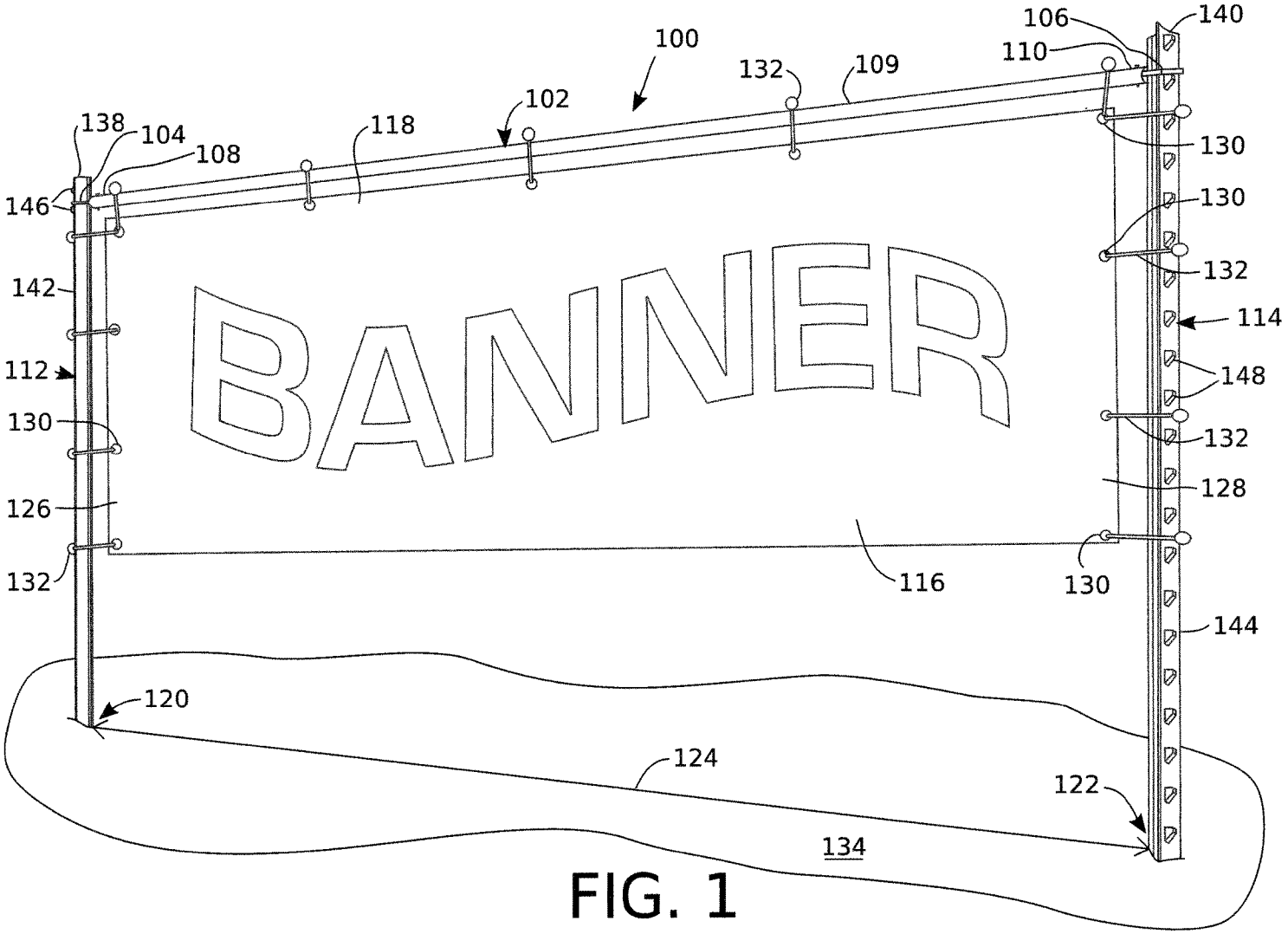
FIG. 1 depicts a perspective view of a banner support, according to one or more embodiments described.

FIG. 1 depicts a perspective view of a banner support 100, according to one or more embodiments. Banner support 100 can include a support structure 102, a first end connector 104, and a second end connector 106. The support structure 102 can include a first end 108 which can attach to and detach from the first end connector 104. The support structure 102 can include a second end 110 which can attach to and detach from the second end connector 106. The support structure 102 can be elongated in that it can have a length 111 that extends between the first end 108 and the second end 110 that is longer than a width 113 (FIG. 2) of the support structure 102. The first end 108 and the first end connector 104 can cooperate to engage a first t-post 112 to support the first end 108 of the support structure 102. The second end 110 and the second end connector 106 can cooperate to engage a second t-post 114 to support the second end 110 of the support structure.

The end connectors can be made from a material such as metal or plastic. In one or more embodiments, the end connectors can be made from aluminum or steel and can be made or formed using progressive die stamping, laser cutting, waterjet cutting, high definition plasma cutting, machining, bending, and/or other metal forming methods.

The support structure 102 can be configured for connecting to a banner 116 along a top edge 118 of the banner 116. A first side edge 126 of the banner 116 can be connected to the first t-post 112 and a second side edge 128 can be connected to the second t-post 114. The banner 116 can include grommets 130 which can be along the edges of the banner 116, and the banner 116 can be connected to the support structure 102 and the t-posts 112 and 114 using ball bungees 132 which can extend through the grommets 130 and around the support structure 102, the t-post 112 and/or the t-post 114.

The banner 116 can be constructed of a flexible material such as vinyl or other sheet material, or can be made of an inflexible material, such as a sheet plastic or metal. The banner 116 can be attached to the support structure using various devices that are known in the art and are not limited to ball bungees.

The support structure 102 can be made from a rigid material. In one or more embodiments the support structure 102 can be made from a metal, such as aluminum or steel. In one or more embodiments, the support structure 102 can be tubing, such as round or square tubing or tubing having another cross sectional shape. In one or more embodiments, the support structure 102 can be one-inch electrical metallic tubing (EMT). In one or more embodiments, the support structure 102 can be tubing having a cross section and wall thickness that is at least as strong as one-inch EMT. In one or more embodiments, the support structure 102 can be made from one or more other materials, such as plastic, and can include solid portions.

The first t-post 112 can be installed at a first t-post position 120, and the second t-post 114 can be installed at a second t-post position 122. The first t-post position 120 and the second t-post position 122 can be at a spaced apart distance 124 from one another. The first t-post 112 and the second t-post 114 can be installed, for example, by driving the t-posts 112 and 114 into the ground 134 using a post driver, a sledge hammer, or other method for installing a t-post, (not shown). The first t-post 112 can be installed with a first end 138 of the first t-post 112 extending away from the ground 134, and the second t-post 114 can be installed with a first end 140 of the second t-post 114 extending away from the ground 134. The ground can be considered to be the earth, dirt, snow, or other such in which a t-post can be driven for displaying a banner. The first t-post can have a length 142 which can extend from the first t-post first end 138 to the ground 134 where the first t-post 112 enters the ground 134. The second t-post 114 can have a length 144 which can extend from the second t-post first end 140 to the ground 134 where the second t-post 114 enters the ground 134. The first t-post 112 can include studs 146 which are spaced apart along at least a portion of the length 142 and which protrude from the first t-post 112. The second t-post 114 can include studs 148 which are spaced apart along at least a portion of the length 144 and which protrude from the second t-post 114.

Figure 2:
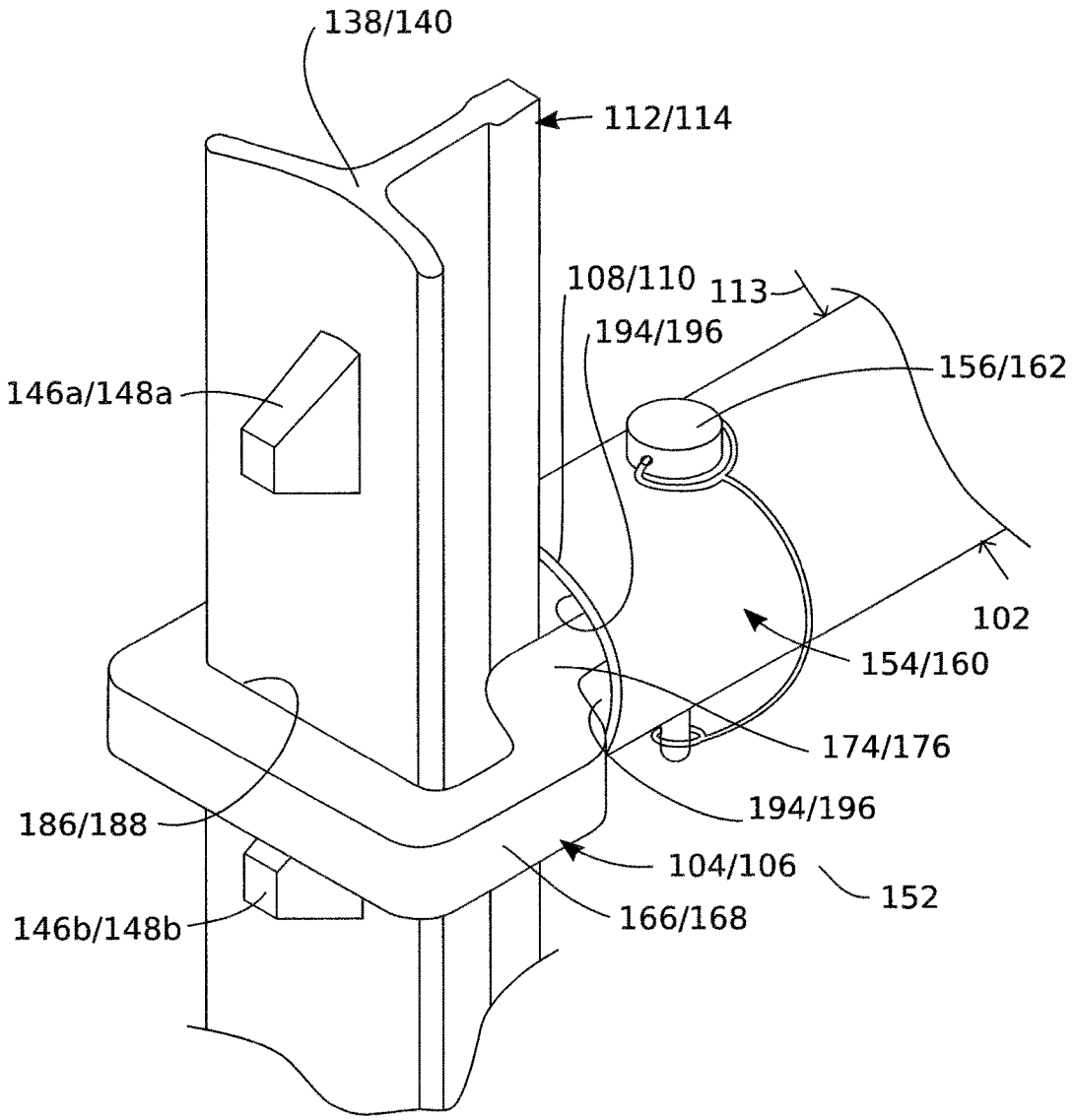
FIG. 2 depicts an enlarged view of a portion of the support structure and the end connector, according to one or more embodiments described.

FIG. 2 depicts an enlarged view of a portion of the support structure 102 and the end connector 104, according to one or more embodiments. The first end 108 of the support structure 102 and the first end connector 104 can cooperate to engage the first t-post 112 to support the first end 108 of the support structure 102. The first end connector 104 can be attached to the support structure in a locked position 152 as shown in FIG. 2. Prior to being attached to the support structure 102 in the locked position 152, the first end connector 104 can be placed over the first t-post first end 138 and can be positioned between two studs 146, such as for example, stud 146*a* and stud 146*b*. After the first end connector 104 is positioned between the two studs 146*a* and 146*b*, the first end connector 104 can be attached to the support structure in the locked position 152 in which the first end 108 of the support structure 102 and the first end connector 104 can engage the first t-post 112 such that the first end connector 104 is prevented from vertically moving past the studs 146. As shown in FIG. 2, the stud 146*b* can support the first end 108 of the support structure 102 through the first end connector 104. The banner support 100 can include a first retainer assembly 154 for end connector 104, which can selectively maintain the first end connector 104 attached to the first end 108 of the support structure 102 in the locked position 152. The first retainer assembly 154 can include a first retainer 156.

FIG. 2 can be representative of two ends of the banner support 100 shown in FIG. 1. The second end 110 and the second end connector 106 can cooperate to engage the second t-post 114 to support the second end 110 of the support structure 102. The second end connector 106 can be attached to the second end 110 of the support structure 102 in the locked position 152. Prior to being attached to the support structure 102 in the locked position 152, the second end connector 106 can be placed over the second t-post first end 140 and can be positioned between two studs 148, such as for example, stud 148*a* and stud 148*b*. After the second end connector 106 is positioned between the two studs 148*a* and 148*b*, the second end connector 106 can be attached to the support structure in the locked position 152 in which the second end 110 of the support structure 102 and the second end connector 106 can engage the second t-post 114 such that the second end connector 106 is prevented from vertically moving past the studs 148. As shown in FIG. 2, the stud 148*b* can support the second end 110 of the support structure 102 through the second end connector 106. The banner support 100 can include a second retainer assembly 160 for end connector 106, which can selectively maintain the end connector 106 attached to the second end 110 of the support structure 102 in the locked position 152. The second retainer assembly 160 can include a second retainer 162.

Stud 146*a* is spaced apart from the first t-post first end 138 and the stud 146*b* is spaced apart from the stud 146*a* and from the first t-post first end 138. Stud 148*a* is spaced apart from the second t-post first end 140 and the stud 148*b* is spaced apart from the stud 148*a* and from the second t-post first end 140. Although shown between studs 146*a* and 146*b*, the first end connector 104 can be positioned between any two of the studs 146 of the first t-post 112. And, although shown between studs 148*a* and 148*b* of the second t-post 114, the second end connector 106 can be positioned between any two of the studs 148 of the second t-post 114. The position can depend on the size of the banner 116, how high off of the ground 134 that the banner 116 is to be supported, and/or how much of the t-posts 112/114 are extending out of the ground 134.

Figure 3:
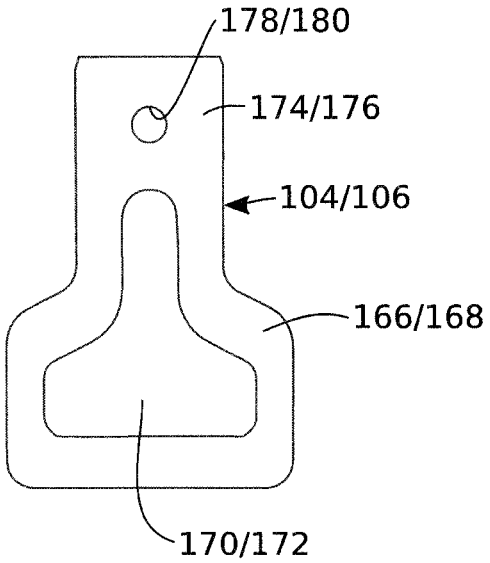
FIG. 3 depicts an enlarged plan view of the end connector, according to one or more embodiments described.

FIG. 3 depicts an enlarged plan view of the end connector 104/106, according to one or more embodiments. The end connector 104/106 can include a body 166/168 which can define an aperture 170/172. The end connector 104/106 can include at least one tab 174/176 and the tab can include a retainer hole 178/180. The aperture 170/172 can have a "T" shape as shown in FIG. 3.

Figure 4:
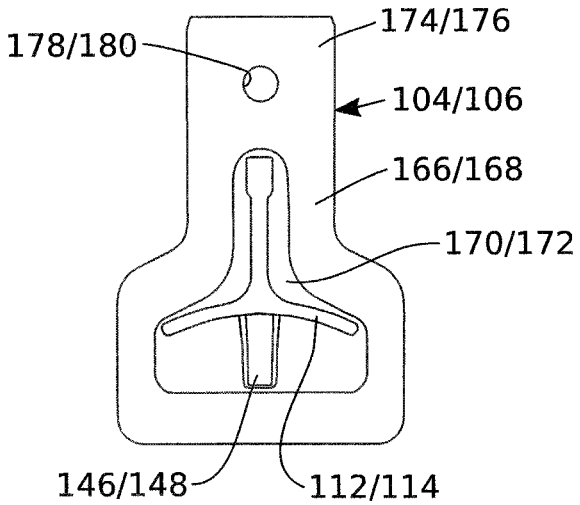
FIG. 4 depicts an enlarged plan view of the end connector with the t-post extending through the aperture, according to one or more embodiments described.

FIG. 4 depicts an enlarged plan view of the end connector 104/106 with the t-post 112/114 extending through the aperture 170/172, according to one or more embodiments. The aperture 170/172 can be sized to allow a t-post, such as t-post 112 or 114, to extend through the aperture 170/172. In one or more embodiments, the aperture can be sized for a 1.33 lb. t-post. In one or more embodiments, the aperture can be sized for a 1.25 lb. t-post. In one or more embodiments, the aperture can be sized for a 0.95 lb t-post. In one or more embodiments, the aperture can be sized to work with more than one size of t-post. When the t-post 112/114 extends through the aperture 170/172 and the end connector 104/106 is not in the locked position 152, the end connector 104/106 is able to move past the studs 146/148 of the t-post 112/114 and can be positioned along the length 142/144 (FIG. 1) of the t-post 112/114.

Figure 5:
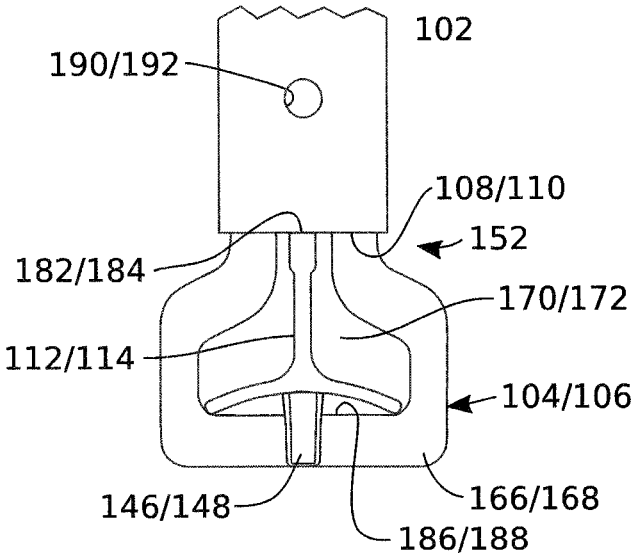
FIG. 5 depicts an enlarged plan view of the end connector in the locked position in the support structure, according to one or more embodiments described.

FIG. 5 depicts an enlarged plan view of the end connector 104/106 in the locked position 152 in the support structure 102, according to one or more embodiments. When the end connector 104/106 is in the locked position 152 in the support structure 102, the support structure end 108/110 can contact the t-post 112/114 to prevent the t-post 112/114 from moving past the studs 146/148. The end 108/110 can contact an edge 182/184 of the t-post 112/114 which can prevent the end connector 104/106 from moving in the aperture 170/172 away from an inner surface 186/188 of the end connector body 166/168.

The ends 108/110 of the support structure 102 can include support structure retainer holes 190/192 which can align with the tab retainer holes 178/180 when the end connector 104/106 is in the locked position 152. The first retainer assembly 154 (FIG. 2) can include the first retainer 156, the first tab retainer hole 178 (FIG. 3), and the first support structure retainer hole 190 (FIG. 5). The second retainer assembly 160 (FIG. 2) can include the second retainer 162, the second tab retainer hole 180 (FIG. 3), and the second support structure retainer hole 188 (FIG. 5). When the end connector 104/106 is in the locked position 152, the tab retainer hole 178/180 can align with the support structure retainer hole 190/192 and the retainer 156/162 (FIG. 2) can extend through the support structure retainer hole 190/192 and at least partially into the tab retainer hole 178/180 to maintain the end connector 104/106 in the locked position 152.

When the end connector 104/106 is in the locked position 152 the end 108/110 of the support structure 102 can engage the t-post 112/114 which can prevent the end connector 104/106 from moving past the t-post studs 146/148. Since the end connector 104/106 cannot move past the studs 146/148 when in the locked position 152, the end connector 104/106 can support the end 108/110 of the support structure 102, which in turn, can support the banner 116.

Figure 6:
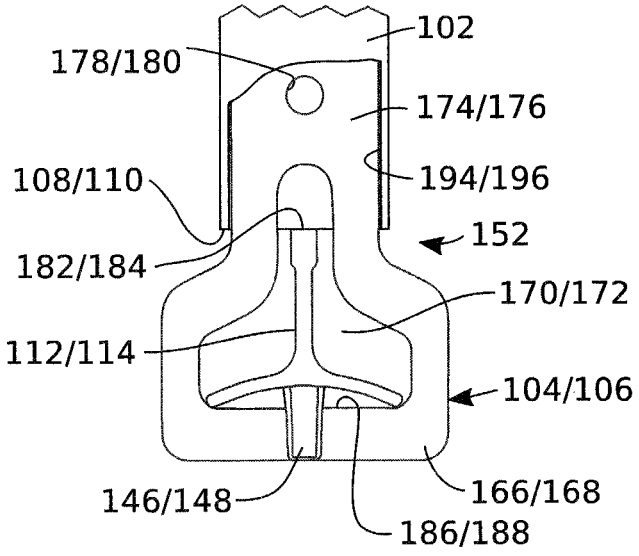
FIG. 6 depicts an enlarged plan view of the end connector in the locked position and a partial cutaway view of the support structure, according to one or more embodiments described.

FIG. 6 depicts an enlarged plan view of the end connector 104/106 in the locked position 152 and a partial cutaway view of the support structure 102, according to one or more embodiments. As shown in FIGS. 2 and 6, the ends 108/110 of the support structure 102 can include openings 194/196, respectively, which can be configured to selectively receive the end connector tab 174/176 for attaching the respective end connector 104/106 to the support structure 102 in the locked position 152.

Figure 7:
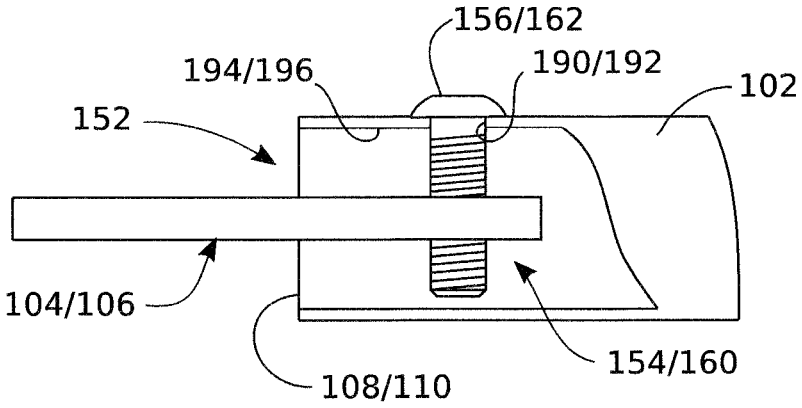
FIG. 7 depicts a side elevation view of the end connector in the locked position and a partial cutaway view of the support structure, according to one or more embodiments described.

FIG. 7 depicts a side elevation view of the end connector 104/106 in the locked position 152 and a partial cutaway view of the support structure 102, according to one or more embodiments. The support structure retainer holes 190/192 can extend at least partially through the support structure 102 and can extend into the openings 194/196. In one or more embodiments, the support structure retainer hole 190/192 can extend all of the way through the support structure 102 and the retainer 156/162 can extend all of the way through the support structure 102 and through the tab retainer hole 178/180. In one or more embodiments, the retainer 156/162 can include a bolt, a pin, or a cotter. In one or more embodiments, the tab retainer hole 178/180 can be threaded and the retainer 156/162 can extend through the support structure retainer hole 190/192 and can threadably attach to the tab retainer hole 178/180 to maintain the end connector 104/106 attached to the support structure 102 in the locked position 152.

Figure 8:
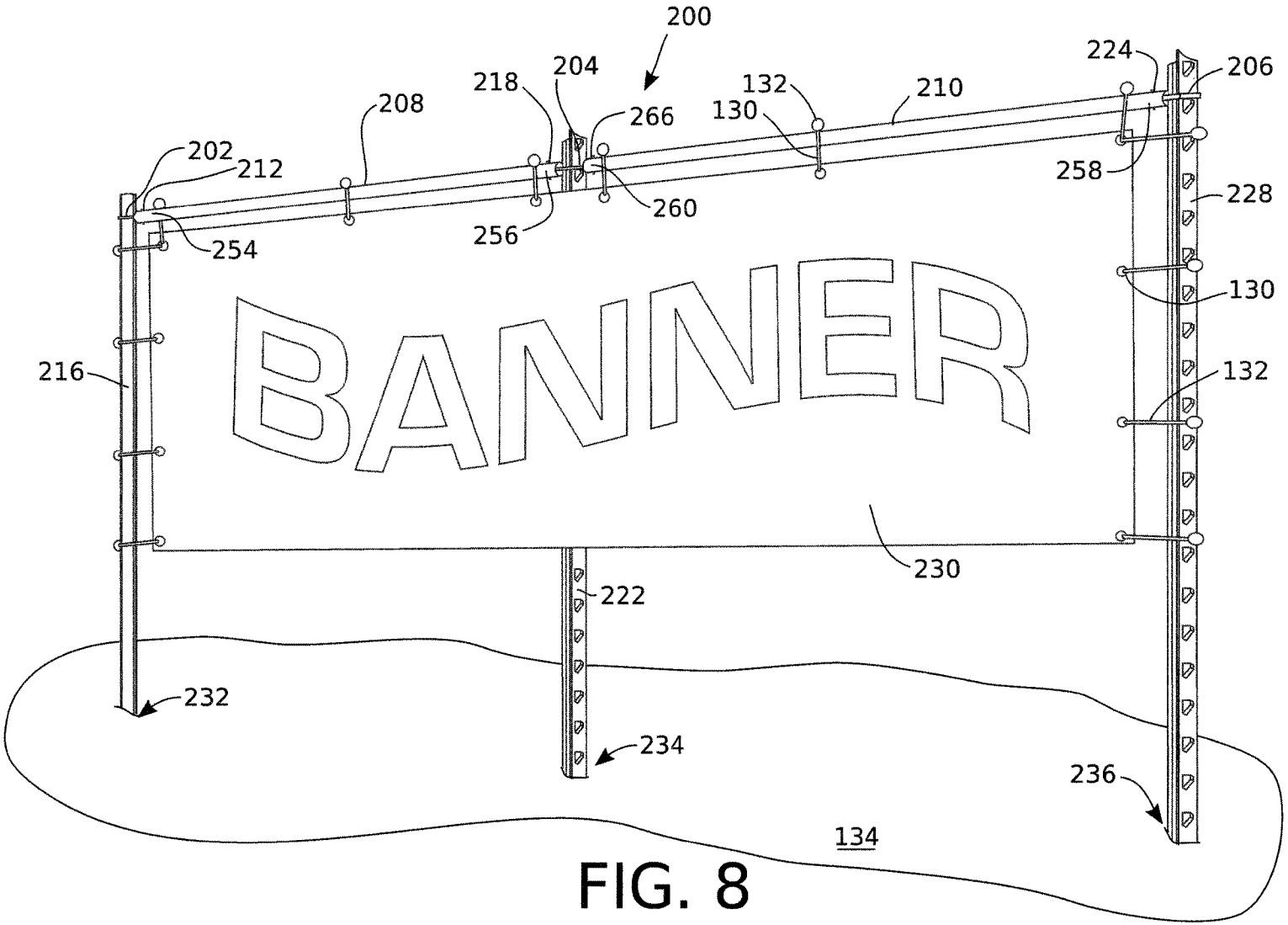
FIG. 8 depicts a perspective view of a banner support, according to one or more embodiments described.

FIG. 8 depicts a perspective view of a banner support 200, according to one or more embodiments. Banner support 200 can include a first end connector 202, a second end connector 204, a third end connector 206, a first support structure 208, and a second support structure 210. The banner support 200 can also include a first retainer assembly 212 for maintaining the first end connector 202 in the locked position 152 on a first t-post 216; a second retainer assembly 218 for maintaining the second end connector 204 in the locked position 152 on a second t-post 222; and a third retainer assembly 224 for maintaining the third end connector 206 in the locked position 152 on a third t-post 228. The first end connector 202 and the third end connector 206 can be similar to the first and second end connectors 104 and 106 as discussed above. The banner support 200 can be connected to and can support a banner 230. The banner 230 can be partially supported from first support structure 208 and partially supported from second support structure 210. The banner support 20 can utilize grommets 130 and ball bungees 132 or other banner connectors as discussed. The banner 230 can be attached to the first t-post 216, the third t-post 228, and, in some embodiments, can be attached to the second t-post 222.

As shown in FIG. 8, the first t-post can be installed at a first location 232, the second t-post can be installed at a second location 234, and the third t-post can be installed at a third location 236 in the ground 134. The first, second and third locations can be spaced apart from one another.

The first end connector 202 can be attached to a first end 254 of the first support structure 208 and a first tab 244 of the second end connector 204 can be attached to a second end 256 of the first support structure 208. The first end connector 202 and second end connector 204 can engage the first and second t-posts, respectively, to support the first support structure 208 and thereby support at least a portion of the banner 230. The retainer assemblies 212 and 218 can maintain the first and second end connectors 202 and 204, respectively in the locked position 152 on the first and second t-posts 216 and 222.

The third end connector 206 can be attached to a first end 258 of the second support structure 210 and the third retainer assembly 224 can maintain the third end connector 206 in the locked position 152 on the third t-post 228.

Figure 9:
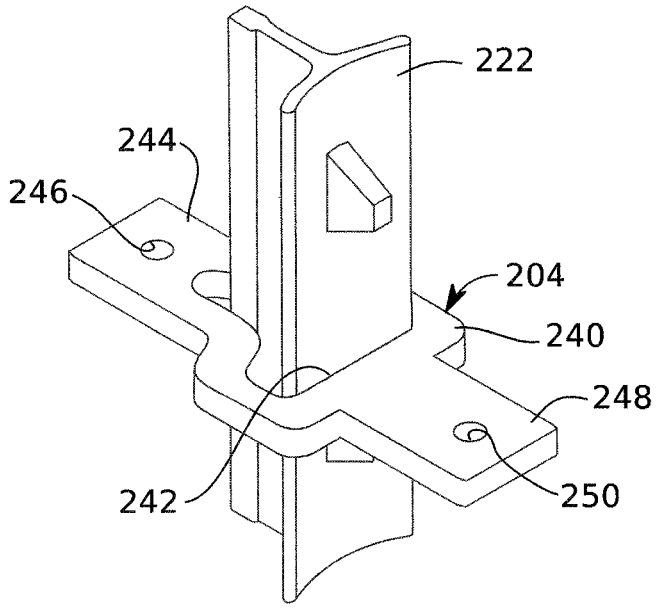
FIG. 9 depicts an enlarged perspective view of the second end connector, according to one or more embodiments described.

FIG. 9 depicts an enlarged perspective view of the second end connector 204, according to one or more embodiments. The second end connector 204 can include a body 240 which can define an aperture 242 which is configured to allow a t-post, such as t-post 222 to extend there through. The second end connector 204 can include a first tab 244 with a first tab retainer hole 246, and a second tab 248 with a second tab retainer hole 250. The second end connector 204 can be a double end connector since the second end connector 204 includes two tabs. Other end connectors may include more than two tabs. The second end connector 204 can also be called a center connector since the connector can be installed between support structures.

Figure 10:
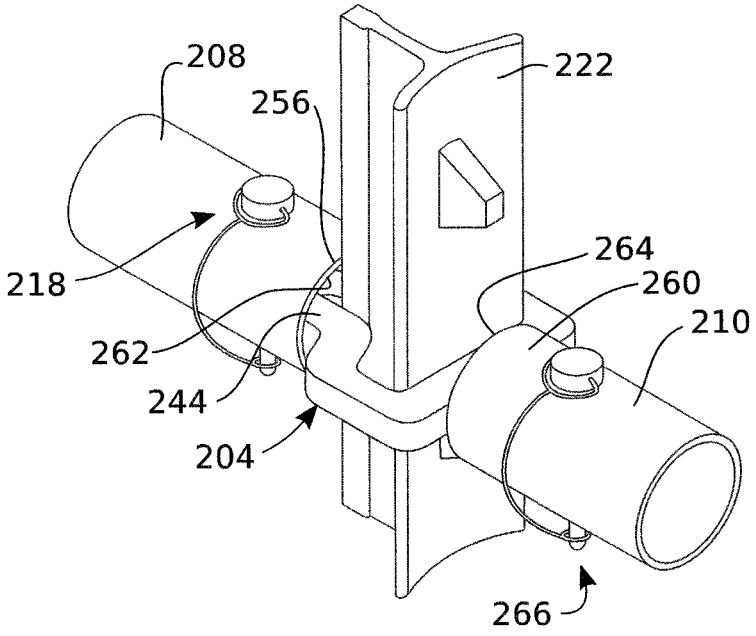
FIG. 10 depicts an enlarged perspective view of the second end connector attached to the first support structure and the second support structure, according to one or more embodiments described.

FIG. 10 depicts an enlarged perspective view of the second end connector 204 attached to the first support structure 208 and the second support structure 210, according to one or more embodiments. The second end connector first tab 244 can be inserted into an opening 262 in the second end 256 of the first support structure 208. The second end connector can be maintained in the locked position 152 using the second retainer assembly 218 which can include a retainer 214.

The second end connector 204 can be connected to the second support structure 210 by inserted the second end connector second tab 248 (FIG. 9) into an opening 264 in a second end 260 of the second support structure 210.

The attachment of the second end 260 of the second support structure 210 and the second end connector 204 can be maintained by a fourth retainer assembly 266. The second end connector second tab 248 can support the second end 260 of the second support structure 210 and the second support structure 210 can support a portion of the banner 230. Since the second end connector first tab 244 cooperates with the first support structure 208 to engage the second t-post 222, the second end connector second tab 248 only needs to connect to the second end 260 of the second support structure 210 to support the second end 260.

The second end connector 204 shown in FIGS. 8-10 is configured so that the first and second support structures 208 and 210 are substantially in a line when installed. The second end connector 204 can allow the first and second support structures 208 and 210 to be installed out of a straight line by a few degrees, which can still be considered to be substantially in a line.

Figure 11:
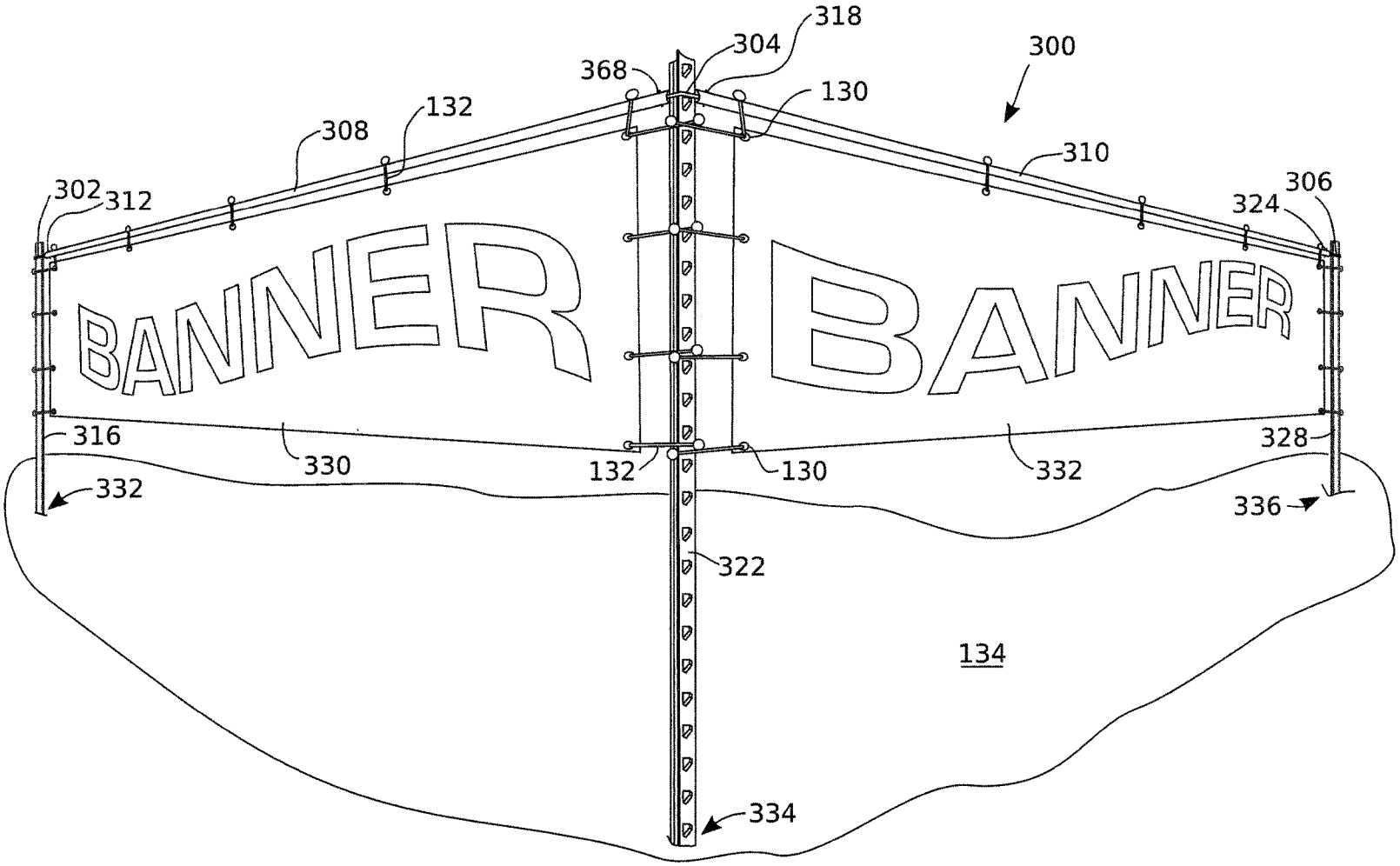
FIG. 11 depicts a perspective view of a banner support, according to one or more embodiments described.

FIG. 11 depicts a perspective view of a banner support 300, according to one or more embodiments. Banner support 300 can include a first end connector 302, a second end connector 304, a third end connector 306, a first support structure 308, and a second support structure 310. The banner support 300 can also include a first retainer assembly 312 for maintaining the first end connector 302 in the locked position 152 on a first t-post 316; a second retainer assembly 318 for maintaining the second end connector 304 in the locked position 152 on a second t-post 322; and a third retainer assembly 324 for maintaining the third end connector 306 in the locked position 152 on a third t-post 328. The first end connector 302 and the third end connector 306 can be similar to the first and second end connectors 104 and 106 as discussed above. The banner support 300 can be connected to and can support a first banner 330 and a second banner 332. In one or more embodiments the banner support 300 can support a single banner that is supported by both first support structure 308 and second support structure 310 and can wrap around from the first t-post 316 to the third t-post 328. The banner support 300 can utilize grommets 130 and ball bungees 132 or other banner connectors as discussed. In one or more embodiments, the banner 330 can be attached to the first t-post 316 and the second t-post 322 and the banner 332 can be attached to the second t-post 322 and the third t-post 328.

As shown in FIG. 11, the first t-post can be installed at a first location 332, the second t-post can be installed at a second location 334, and the third t-post can be installed at a third location 336 in the ground 134. The first, second and third locations can be spaced apart from one another.

The first end connector 302 can be attached to a first end 354 of the first support structure 308 and a first tab 344 of the second end connector 304 can be attached to a second end 356 of the first support structure 308. The first end connector 302 and second end connector 304 can engage the first and second t-posts, respectively, to support the first support structure 308 and thereby support at least a portion of the banner 330. The retainer assemblies 312 and 318 can maintain the first and second end connectors 302 and 304, respectively in the locked position 152 on the first and second t-posts 316 and 322.

The third end connector 306 can be attached to a first end 358 of the second support structure 310 and the third retainer assembly 324 can maintain the third end connector 306 in the locked position 152 on the third t-post 328.

Figure 12:
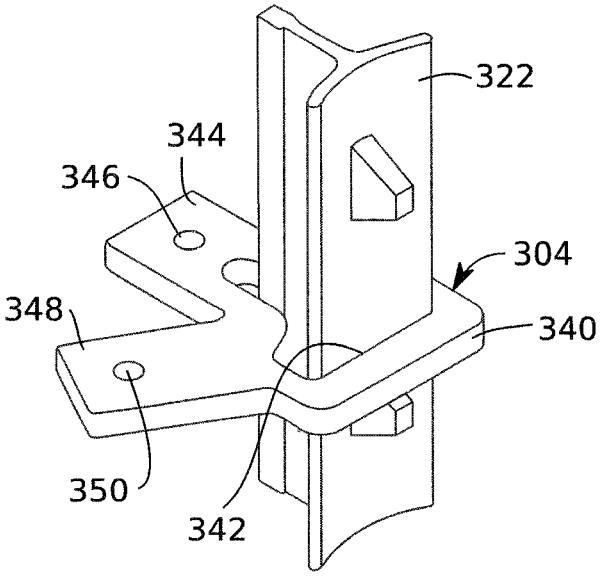
FIG. 12 depicts an enlarged perspective view of the second end connector, according to one or more embodiments described.

FIG. 12 depicts an enlarged perspective view of the second end connector 304, according to one or more embodiments. The second end connector 304 can include a body 340 which can define an aperture 342 which is configured to allow a t-post, such as t-post 322 to extend there through. The second end connector 304 can include a first tab 344 with a first tab retainer hole 346, and a second tab 348 with a second tab retainer hole 350. The first tab 344 and the second tab 348 can be arranged at an angle relative to one another. The second end connector 304 can be called a double end connector since the second end connector 304 includes two tabs. The second end connector 304 can also be called a center end connector since the second end connector 304 can be installed between support structures. The second end connector 304 can also be called an angle connector since the connector tabs can be arranged at an angle relative to one another. Other angle end connectors may include more than two tabs which can be at different angles or the same angles relative to one another.

Figure 13:
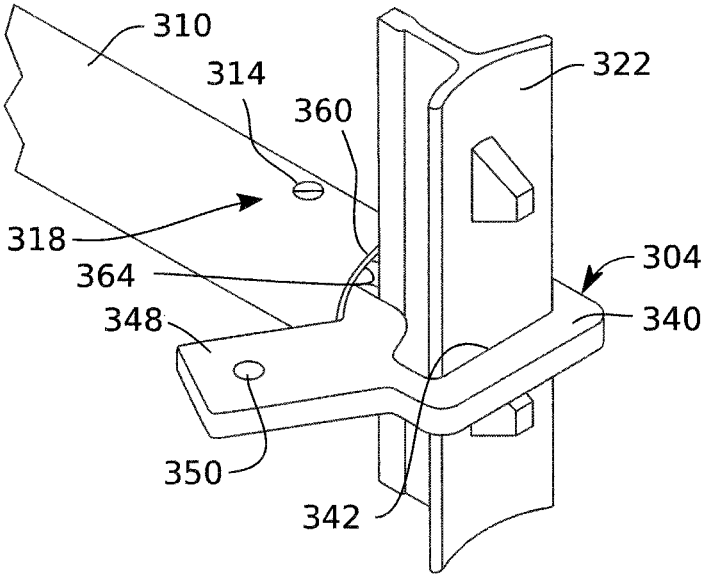
FIG. 13 depicts an enlarged perspective view of the second end connector connected to the second support structure, according to one or more embodiments described.

FIG. 13 depicts an enlarged perspective view of the second end connector 304 connected to the second support structure, according to one or more embodiments. The second end connector first tab 344 can be inserted into an opening 364 in the second end 360 of the second support structure 310. The second end connector 304 can be maintained in the locked position 152 using the second retainer assembly 318 which can include a retainer 314.

Figure 14:
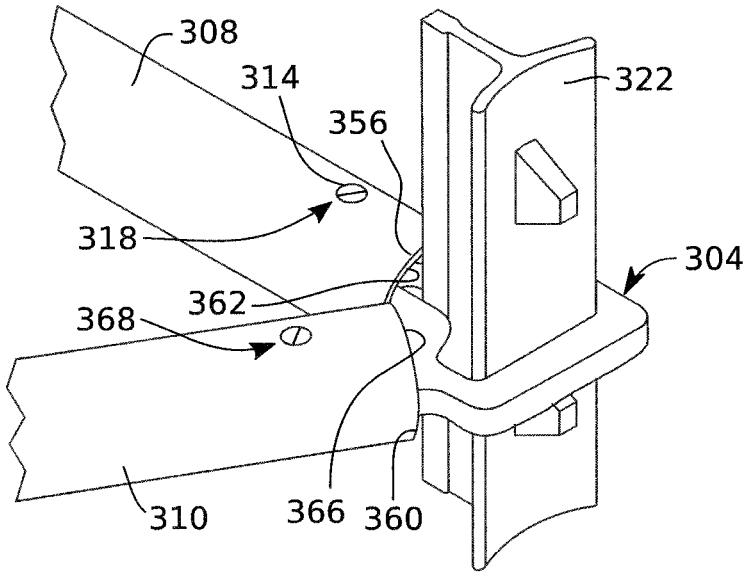
FIG. 14 depicts an enlarged perspective view of the second end connector attached to the second support structure and the first support structure, according to one or more embodiments described.

FIG. 14 depicts an enlarged perspective view of the second end connector 304 attached to the second support structure 310 and the first support structure 308, according to one or more embodiments. The second end connector 304 can be connected to the first support structure 308 by inserted the second end connector first tab 348 (FIG. 12) into an opening 366 in the second end 356 of the first support structure 308. The attachment of the second end 356 of the first support structure 308 and the second end connector 304 can be maintained by a fourth retainer assembly 368. The second end connector first tab 348 can support the second end 360 of the first support structure 308 and the first support structure 308 can support at least a portion of the banner 330. Since the second end connector second tab 344 cooperates with the second support structure 310 to engage the second t-post 222, the second end connector first tab 348 only needs to connect to the second end 260 of the first support structure 308 to support the second end 360. The second end connector 304 shown in FIGS. 11-14 is configured so that the first and second support structures 308 and 310 are arranged at an angle to one another.

In one or more embodiments, the support structures can be sized to support banners that are longer or shorter than those shown. The support structures can be made in standard sizes, such as, for example, the support structure can be 4'-6" to support a 4' banner; 6'-6" to support a 6' banner; and 8'-6" to support an 8' banner. In the banner supports having more than one support structures, the support structures can be the same size or different sizes from one another. The support structures can be made in other lengths for other sizes of banners and can be custom lengths and/or strengths to accommodate different sized banners.

Figure 15:
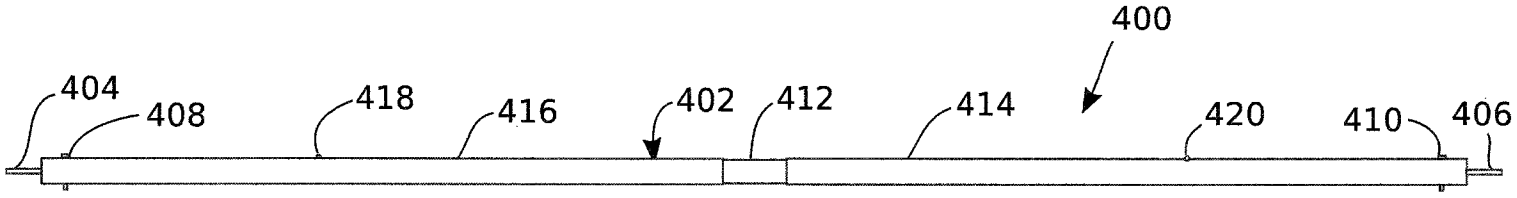
FIG. 15 depicts a side elevation view of a banner support, according to one or more embodiments described.
Figure 16:
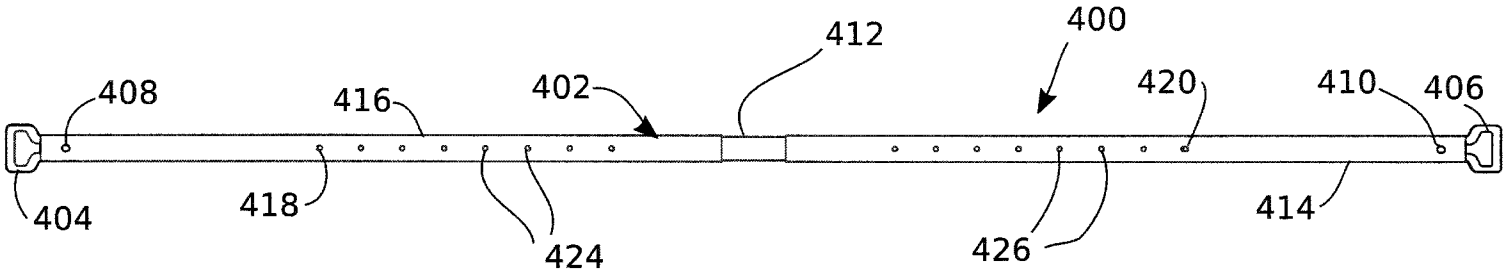
FIG. 16 depicts a top view of the banner support, according to one or more embodiments described.

FIG. 15 depicts a side elevation view of a banner support 400, according to one or more embodiments. FIG. 16 depicts a top view of the banner support 400, according to one or more embodiments. Banner support 400 can include an adjustable support structure 402, a first end connector 404, a second end connector 406, a first retainer assembly 408, and a second retainer assembly 410.

Figure 17:
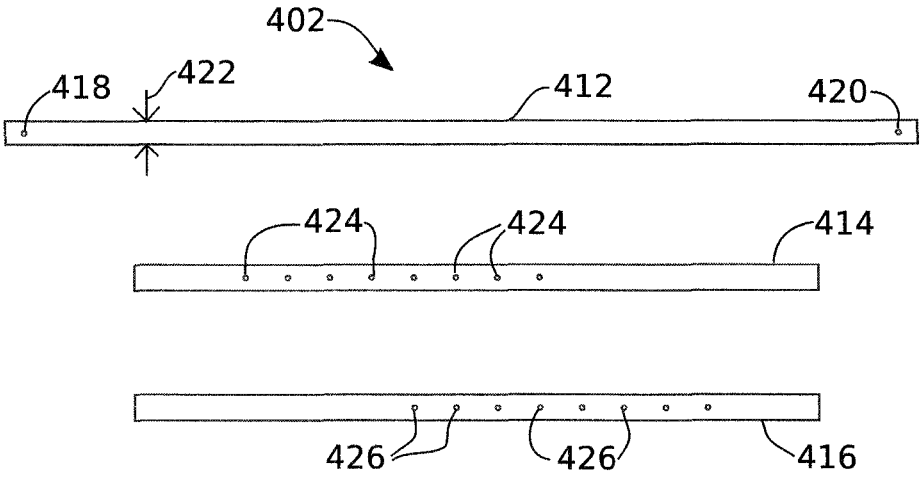
FIG. 17 depicts a disassembled view of the adjustable support structure shown in FIGS. 15 and 16, according to one or more embodiments described.

FIG. 17 depicts a disassembled view of the adjustable support structure 402 shown in FIGS. 15 and 16, according to one or more embodiments. The adjustable support structure 402 can include a first section 412, a second section 414, and a third section 416. The first section 412 can include a first button 418 and a second button 420. The buttons 418 and 420 can be spring loaded and can extend out from the surface of the first section 412. The first section 412 can be tubing and can have an outer diameter 422. The second section 414 can include a series of holes 424 which can be arranged along the length of the second section 414; and the third section 416 can include a series of holes 426 which can be arranged along the length of the third section 416. The second and third sections 414 and 416 can be tubing and can have inner diameters (not specifically shown) which are sized to allow the first section 412 to slide longitudinally within the second and third sections 414 and 416.

The holes 424 and the button 418 can be sized such that the button 418 can extend at least partially into the holes 424, one at a time, to lock the first section 412 longitudinally in the second section 414. The button 418 can be pressed to push against the bias of the spring to move the button out of a hole to allow the second section 414 to move longitudinally relative to the first section 412. The holes 426 and the button 420 can be sized such that the button 420 can extend at least partially into the holes 426, one at a time, to lock the first section 412 longitudinally in the third section 416. The button 420 can be pressed to push against the bias of the spring to move the button out of a hole to allow the third section 416 to move longitudinally relative to the first section 412. The length of the adjustable support structure 402 can be adjusted by moving the second and/or third sections 414 and 416 longitudinally relative to the first section 412. The length of the adjustable support structure 402 can be maintained by the engagement of the button 418 with one of the holes 424, and the engagement of the button 420 with one of the holes 426. The adjustable support structure 402 can be considered to be telescoping. In one or more embodiments, the adjustable support structure 402 can adjust from a length of about 6'-6" to about 8'-6" which can be used to support banners varying in length from about 6' to about 8'. In one or more embodiments, the adjustable support structure 402 can adjust from lengths shorter or greater than 6'6" and/or shorter or greater than 8'-6" to support banners shorter than 6' and/or longer than 8'.

The banner support described herein can support one or more banners for display, and can prevent the posts to which the banner support is connected from moving toward one another. The banner support can prevent the t-posts from collapsing inward when a connected banner is under wind load by resisting a compressive force applied to the support structure from the t-posts as a result of wind blowing on the connected banner. The banner support can also provide support for the top edge of the banner so that users do not have to simply attach the banner at the side edges.

The banner support can be used with t-posts that are common and are readily available at most home supply, hardware and ranch supply retailers. Schedule 20 1½ inch PVC pipe can be placed over the t-posts to hide the posts, and a PVC cap can also be added to each post to further improve the appearance of the banner support installation.

The double tab end connectors can be used to allow multiple lengths to be connected for wider, or multiple banners. Although shown with one or two support structures in the examples discussed, the combination of double and single tab end connectors can be used for multiple support structures connected in a row. The angled double tab end connector can be used to display banners in a way that can be seen by traffic traveling in two directions.

Although the preceding description has been described herein with reference to particular means, materials, and embodiments, it is not intended to be limited to the particulars disclosed herein; rather, it extends to all functionally equivalent structures, processes, and uses, such as are within the scope of the appended claims.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for supporting a banner, comprising:

installing a first t-post at first position with a first t-post first end extending away from the ground;

installing a second t-post at a second position, at a spaced apart distance from the first position, with a second t-post first end extending away from the ground;

placing a first end connector over the first t-post first end and positioning the first end connector between two studs of the first t-post that are spaced apart from one another and spaced apart from the first t-post first end;

placing a second end connector over the second t-post second end and positioning the second end connector between two studs of the second t-post that are spaced apart from one another and spaced apart from the second t-post first end;

inserting a first end connector tab of the first end connector into a first end of an elongate support structure and securing the first end connector tab of the first end connector in the first end of the support structure such that the first end of the support structure and the first end connector cooperate to maintain the first end connector between the two studs of the first t-post to support the first end of the support structure;

inserting a first end connector tab of the second end connector into a second end of the elongate support structure and securing the first end connector tab of the second end connector in the second end of the support structure such that the second end of the support structure and the second end connector cooperate to maintain the second end connector between the two studs of the second t-post to support the second end of the support structure; and attaching at least a portion of a top edge of the banner to the support structure.

2. The method as defined in claim 1, further comprising:

extending the support structure from a first length, that is shorter than the distance between the first t-post and the second t-post, to a second length that is at least approximately the same as the distance between the first t-post and the second t-post.

3. The method as defined in claim 1, further comprising;

contacting the first t-post with the first end of the support structure and contacting the second t-post with the second end of the support structure such that the support structure is positioned to resist movement of the first t-post first end toward the second t-post first end.

4. The method as defined in claim 1 wherein securing the first end connector tab in the first end includes inserting a retainer through at least a portion of the support structure and through at least a portion of the first end connector tab.

5. The method as defined in claim 4 wherein inserting the retainer includes screwing the retainer into the first end connector tab.

6. The method as defined in claim 1, wherein the aforementioned support structure is a first support structure, wherein the second end connector tab is a second end connector first tab, the method further comprising:

installing a third t-post at a third position, at a spaced apart distance from the first position and the second position, with a third t-post first end extending away from the ground;

placing a third end connector over the third t-post first end and positioning the third end connector between two studs of the third t-post that are spaced apart from one another and spaced apart from the third t-post first end;

inserting a end connector tab of the third end connector into a first end of a second elongate support structure and securing the end connector tab of the third end connector in the first end of the second support structure such that the first end of the second support structure and the third end connector cooperate to maintain the third end connector between the two studs of the third t-post to support the first end of the second support structure; and inserting a second end connector tab of the second end connector into a second end of the second support structure and securing the second end connector tab of the second end connector in the second end of the second support structure to support the second end of the second support structure; and attaching a portion of the top edge of the banner to the second support structure.

7. The method as defined in claim 6, wherein the third t-post is installed such that the first and second support structures are substantially in a line.

8. The method as defined in claim 6, wherein the third t-post is installed such that the first and second support structures are at an angle relative to one another.

9. A banner support, comprising:

at least one end connector having body which defines an aperture that is sized to allow a t-post to extend through the aperture, the end connector including at least one tab;

an elongate support structure configured for connecting to a top edge of a banner and having a strength capable at least of supporting the banner, the support structure having an end with an end opening that is configured to selectively receive the end connector tab for attaching the end connector to the support structure in a locked position, and configured to selectively release the tab to at least partially detach the end connector from the support structure; and a retainer assembly for selectively maintaining the end connector attached to the support structure in the locked position, and wherein the end connector and the support structure are configured such that when the t-post extends through the aperture and the end connector is in the locked position, the end connector engages the t-post and is prevented from moving past studs of the t-post to support the end of the support structure, and when the t-post extends through the aperture and the end connector is not in the locked position, the end connector is able to move past the studs of the t-post and can be positioned along the length of the t-post.

10. The banner support as defined in claim 9, wherein the retainer assembly includes a retainer, a tab retainer hole defined by the end connector tab, and at least one support structure retainer hole defined by the support structure, the tab retainer hole and the support structure retainer hole and the retainer configured such that the retainer extends through the support structure hole and at least partially through the tab retainer hole to maintain the end connector attached to the support structure in the locked position.

11. The banner support as defined in claim 10, wherein the support structure retainer hole extends through the support structure and the retainer extends through the tab retainer hole and the support structure hole to maintain the end connector attached to the support structure in the locked position.

12. The banner support as defined in claim 10, wherein the retainer extends through the support structure retainer hole and threadably attaches to the tab retainer hole to maintain the end connector attached to the support structure in the locked position.

13. The banner support as defined in claim 10, wherein the retainer is one of a bolt or a pin.

14. The banner support as defined in claim 10, wherein the support structure is a tube.

15. The banner support as defined in claim 10, wherein the support structure has a length that is adjustable.

16. The banner support as defined in claim 10, wherein the aperture of the end connector includes a "T" shape.

17. The banner support as defined in claim 10, wherein the support structure includes a second end and wherein there is a second end connector for engaging another t-post to support the second end of the support structure.

18. A banner support for supporting a banner between at least a first t-post and a second t-post that are installed at a spaced apart distance from one another, comprising:

an elongate support structure having a first end and a second end and a length that extends between the first end and the second end, the support structure configured to attach to a top edge of a banner and having a strength at least sufficient to support the banner;

a first end connector having a body with a tab, the body defining a fixed aperture that is configured to allow the first t-post to extend there through, and wherein the tab is configured to be selectively inserted into the first end of the support structure to a locked position in which when the first t-post extends through the aperture the first t-post is engaged by the first end connector and the first support structure end such that the first end connector is maintained between two studs of the first t-post and the first end of the support structure is supported;

a second end connector having a body with a tab, the body defining a fixed aperture that is configured to allow the second t-post to extend there through, and wherein the tab is configured to be selectively inserted into the second end of the support structure to a locked position in which when the second t-post extends through the aperture the second t-post is engaged by the second end connector and the second support structure end such that the second end connector is maintained between two studs of the second t-post and the second end of the support structure is supported.

19. The banner support as defined in claim 18, further comprising:

a first retainer assembly configured for selectively maintaining the first end connector attached to the first end of the support structure in the locked position; and a second retainer assembly configured for selectively maintaining the second end connector attached to the second end of the support structure in the locked position.

20. The banner support as defined in claim 18, the banner support for supporting the banner between the first t-post, the second t-post and a third t-post that are each installed at spaced apart distances from one another, and wherein the aforementioned support structure is a first support structure, and wherein the tab of the second end connector is a first tab and the second end connector having a second tab, the banner support further comprising:

a second elongate support structure having first end and a second end and a length that extends between the first end and the second end, the second support structure configured to attach to the top edge of a banner and having a strength at least sufficient to support the banner, and wherein the second tab of the second end connector is configured to be selectively connected to the first end of the second support structure to support the first end of the second support structure;

a third end connector having a body with a tab, the body defining a fixed aperture that is configured to allow the third t-post to extend there through, and wherein the tab is configured to be selectively inserted into the second end of the second support structure to a locked position in which when the third t-post extends through the aperture the third t-post is engaged by the third end connector and the second end of the second support structure such that the third end connector is maintained between two studs of the third t-post and the second end of the second support structure is supported.

* * * * *